US007543388B2

(12) United States Patent
Christensen et al.

(10) Patent No.: US 7,543,388 B2
(45) Date of Patent: Jun. 9, 2009

(54) REVEAL TOOL

(75) Inventors: Joseph W. Christensen, Lakeshore, MN (US); Dale D. Johnson, Deerwood, MN (US)

(73) Assignee: Northern Building Solutions, Inc., Lakeshore, MN (US)

( * ) Notice: Subject to any disclaimer, the term of this patent is extended or adjusted under 35 U.S.C. 154(b) by 0 days.

(21) Appl. No.: 11/799,634

(22) Filed: May 2, 2007

(65) Prior Publication Data

US 2007/0261256 A1 Nov. 15, 2007

Related U.S. Application Data

(60) Provisional application No. 60/796,680, filed on May 2, 2006.

(51) Int. Cl.
*G01B 3/14* (2006.01)

(52) U.S. Cl. ..... 33/194; 33/562

(58) Field of Classification Search ..... 33/1 G, 33/41.1, 41.6, 42, 194, 197, 480, 481, 535, 33/562, 563, 564, 565, 566
See application file for complete search history.

(56) References Cited

U.S. PATENT DOCUMENTS

| | | | | | |
|---|---|---|---|---|---|
| 924,877 | A * | 6/1909 | Banfill | 33/566 |
| 1,135,259 | A * | 4/1915 | Cokely | 33/481 |
| 1,633,163 | A * | 6/1927 | Crouse | 33/565 |
| 2,204,927 | A * | 6/1940 | Cramer | 33/481 |
| 2,473,639 | A * | 6/1949 | Erickson | 33/42 |
| 2,720,706 | A * | 10/1955 | Laine | 33/566 |
| 5,577,328 | A * | 11/1996 | Kerry, Sr. | 33/563 |
| 5,762,115 | A * | 6/1998 | Shouse | 33/562 |
| 5,940,979 | A * | 8/1999 | Ericksen et al. | 33/562 |
| 6,886,268 | B1 * | 5/2005 | Morse | 33/481 |
| 2003/0070310 | A1 * | 4/2003 | Werner et al. | 33/474 |
| 2005/0022397 | A1 * | 2/2005 | Neblo | 33/194 |

* cited by examiner

*Primary Examiner*—G. Bradley Bennett
(74) *Attorney, Agent, or Firm*—Fredrikson & Byron, P.A.

(57) ABSTRACT

Some embodiments of the present invention provide a simple convenient way to mark reveal widths with excellent accuracy. In some aspects, the invention provides a tool for marking reveal widths. The tool includes a base and positioning means for contacting first and second jambs of a door or window. The tool also includes guiding means for guiding a writing instrument. The guiding means can guide the writing instrument on and generally parallel to the first jamb at a first lateral distance from where the positioning means contacts the first jamb. The guiding means can also guide the writing instrument on and generally parallel to the second jamb at a second lateral distance from where the positioning means contacts the second jamb. In this embodiment, the first lateral distance is a first reveal width and the second lateral distance is a second reveal width.

23 Claims, 7 Drawing Sheets

REVEAL TOOL

CROSS-REFERENCE TO RELATED APPLICATION

This application claims priority under 35 U.S.C. § 119(e) to U.S. provisional application 60/796,680, filed May 2, 2006, which is hereby incorporated by reference in relevant part.

TECHNICAL FIELD

This document relates to tools for easily marking reveal widths.

BACKGROUND

In many contexts, before a craftsperson can apply casing to windows and/or doors, he or she must set a reveal width and mark that reveal width on the jambs for the windows and/or doors to which the casing is to be applied. The reveal width is the distance from the interior surface of the jambs to the interior surface of the casing. In the United States, typical reveal widths are ⅛ in. (0.3175 cm), ¼ in. (0.635 cm), and ⅜ in. (0.9525 cm), though other reveal widths are clearly possible. In other parts of the world, the typical reveal widths likely differ from those in the United States.

To mark reveal widths, craftspeople often use a standard tape measure and a pencil. They hold the tape measure at the interior surface of the jamb and measure outwardly to the predetermined reveal width. They then draw a free-hand line with their pencils on the door jamb to indicate the reveal width. They typically repeat this process of marking reveal widths eight times per window/door—twice on each of the four jambs, often at or near the corners.

Only after the reveal widths are marked do craftspeople typically attach the casing. They often position the casing such that the interior surface of the casing is aligned with the reveal marks on the jambs and the interior points of the mitered edges are aligned with the corners. Once positioned, the casing can be fastened to the jambs (e.g., by finishing nails).

The process of marking reveal widths can be cumbersome and/or time-consuming. Aligning the tape measure eight times per window/door can be time consuming. This is especially so because craftspeople often do not use the end of the tape measures due to inaccuracies that result from the tab becoming loose. Instead, craftspeople often align the 1 in. marker of a common American tape measure with the interior surface of the jambs and measure the reveal width to, e.g., 1⅛ in. Aligning the 1 in. marker with the interior surface of the jambs can consume valuable time. Moreover, to perform the alignment, and to mark the reveal width, the craftsperson needs to be able to see the tape measure, so he or she must be at eye level with the tape measure. To do so for the top jamb on many windows and doors, he or she must use, e.g., a ladder. Positioning and re-positioning ladders can be cumbersome and time consuming.

Tools other than tape measures can also assist in marking reveal widths. For example, an adjustable tri-square can be used. Adjustable tri-squares, however, tend to be rather large and bulky. Carrying them in one's pocket or tool belt can be difficult, if not impossible. Furthermore, in order to mark all of the reveal widths on the window/door, a craftsperson must still make eight marks with the adjustable tri-square, meaning that the adjustable tri-square must be turned both ways at each corner. Moreover, with each turn, the adjustable tri-squares must be reset for the new orientation. Additionally, due to the difficulty of getting the adjustable tri-square into the corner of the jambs, pencil marks typically have to be relatively long. Long pencil marks can be problematic, given that pencil marks can show on the finished windows/doors in the absence of a dark finishing stain.

Marking reveal widths according to the methods described above can also lead to inaccuracies. Mis-aligning the tape measure, mis-reading the tape measure, and mis-marking distances can all lead to inaccurately marked reveal widths. Using adjustable tri-squares can also lead to inaccuracies. Moreover, using the tape measure as described above often involves free-hand line drawing, which can often lead to inaccuracies. Furthermore, small inaccuracies in reveal width markings can have a significant detriment to the appearance of the casing. In other words, the two casing pieces that meet in a corner may not be oriented perpendicularly to each other, which would prevent their mitered edges from fitting together snugly.

Guarding against the difficulties associated with the above-discussed methods for marking reveal widths often requires a more experienced craftsperson to perform the task of marking the reveal widths. Marking accurately and efficiently is often a skill that is developed through experience. When such an experienced craftsperson is required to mark reveal widths, he or she is likely unable to simultaneously perform other tasks.

SUMMARY

Some embodiments of the present invention provide a simple convenient way to mark reveal widths with excellent accuracy. Various aspects of the present invention may be implemented using a using a system, method, apparatus, or any combination of systems, methods, apparatuses, and tools.

In one aspect, the invention provides a tool for marking reveal widths. The tool includes a base and first and second positioning members. The first and second positioning members extend from the base and are adapted to contact a first jamb and a second jamb, respectively, of a door or window. The tool also includes first and second groove rays. The first groove ray extends through the base at a first lateral distance from where the first positioning member is adapted to contact the first jamb, and it runs generally parallel to the first jamb. The second groove ray extends through the base at a second lateral distance from where the second positioning member is adapted to contact the second jamb, and it runs generally parallel to the second jamb. In this embodiment, the first lateral distance is a first reveal width and the second lateral distance is a second reveal width.

In a second aspect, the invention provides a tool for marking reveal widths. The tool includes a base and positioning means for contacting first and second jambs of a door or window. The tool also includes guiding means for guiding a writing instrument. The guiding means can guide the writing instrument on and generally parallel to the first jamb at a first lateral distance from where the positioning means contacts the first jamb. The guiding means can also guide the writing instrument on and generally parallel to the second jamb at a second lateral distance from where the positioning means contacts the second jamb. In this embodiment, the first lateral distance is a first reveal width and the second lateral distance is a second reveal width.

Some embodiments of the reveal tool significantly improve the accuracy of marking reveal widths. For instance, the craftsperson need not use a tape measure to measure the reveal width, and he or she need not make a freehand marking.

Instead, the craftsperson can simply press the reveal tool in the corner of the jambs and trace along the jambs within the chosen groove.

Some embodiments of the reveal tool significantly improve the efficiency of marking reveal widths. In many embodiments, craftspeople can reach up and press the reveal tool into the upper corners and trace along the jambs within the chosen grooves without having to be at eye level with the top jamb. In such embodiments, the craftspeople need not position and re-position ladders. These and other efficiency enhancements can allow marking reveal widths to be done as much as 20 times faster.

Some reveal tool embodiments can be relatively compact. Some reveal tool embodiments are small enough to fit in a standard pocket or tool belt. Some reveal tool embodiments are smaller than 4 in. (10.16 cm) high, 4 in. (10.16 cm) wide, and 1 in. (2.54 cm) thick.

Some embodiments of the present invention provide one or more of the following advantages. In some embodiments, the reveal tool may make marking reveal widths significantly simpler, thereby allowing a relatively inexperienced person to perform the task and freeing up a more experienced person to perform more complicated tasks. In some embodiments, the reveal tool can be manufactured relatively easily and inexpensively. In some embodiments, the reveal tool can be manufactured relatively precisely to enhance the uniformity of reveal widths from one reveal tool to another. In some embodiments, the grooves can be spaced to guide a standard pencil, a carpenter's pencil, or any other suitable writing instrument. In some embodiments, reveal widths can be marked with shorter lines, thereby minimizing the potential for having pencil marks showing through the finishing stain. Some embodiments may allow craftspeople to mark multiple reveal widths using the same tool. Other aspects, features, and advantages will be apparent from the following detailed description, the drawings, and the claims.

BRIEF DESCRIPTION OF FIGURES

The following drawings are illustrative of particular embodiments of the present invention and therefore do not limit the scope of the invention. The drawings are not to scale (unless so stated) and are intended for use in conjunction with the explanations in the following detailed description. Embodiments of the present invention will hereinafter be described in conjunction with the appended drawings, wherein like numerals denote like elements.

DETAILED DESCRIPTION OF ILLUSTRATIVE EMBODIMENTS

The following detailed description is exemplary in nature and is not intended to limit the scope, applicability, or configuration of the invention in any way. Rather, the following description provides practical illustrations for implementing exemplary embodiments of the present invention. Examples of constructions, materials, dimensions, and manufacturing processes are provided for selected elements, and all other elements employ that which is known to those of skill in the field of the invention. Those skilled in the art will recognize that many of the examples provided have suitable alternatives that can be utilized.

Figure 1:
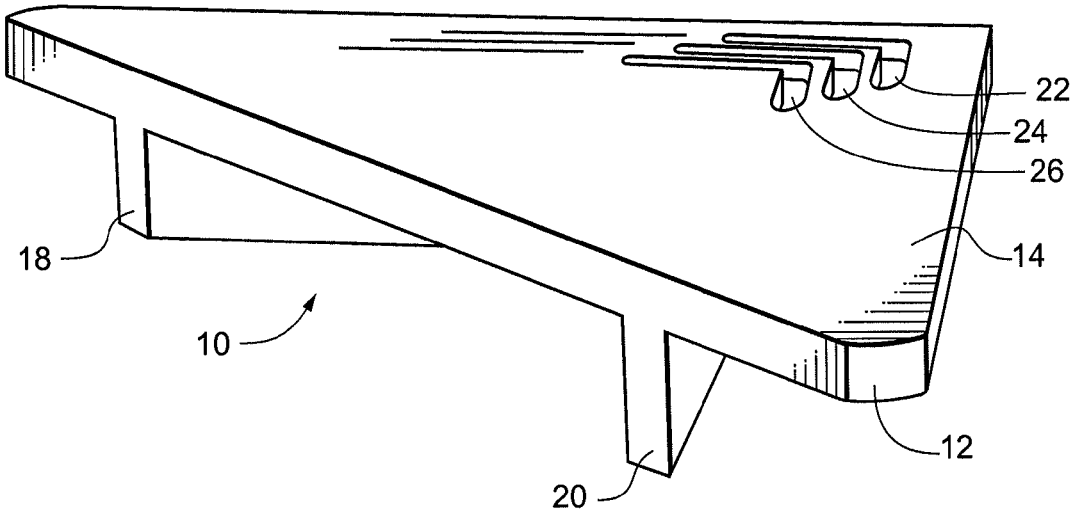
FIGS. 1-7 are perspective views of a reveal tool, according to some embodiments of the present invention.
Figure 2:
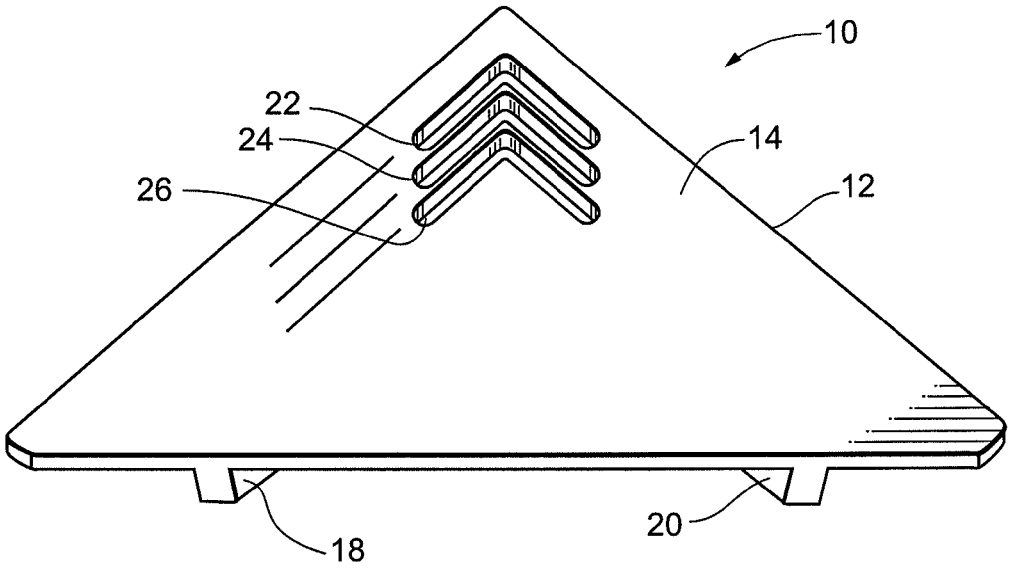
Figure 3:
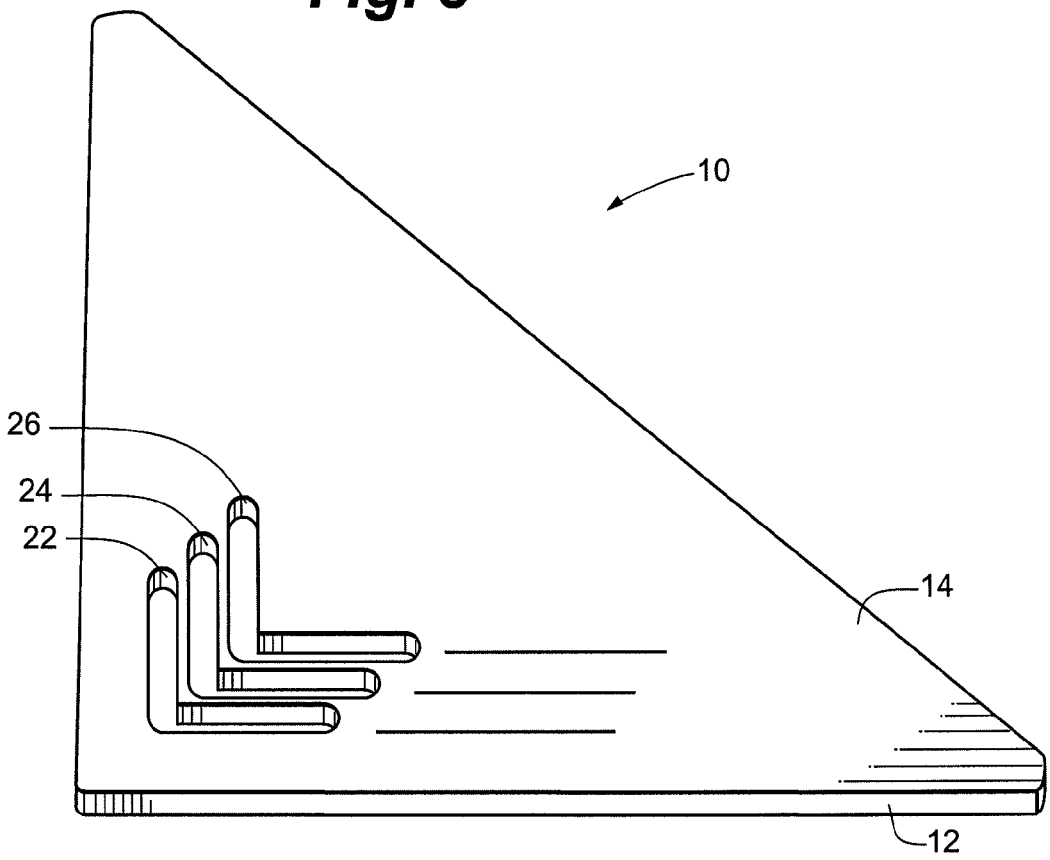
Figure 4:
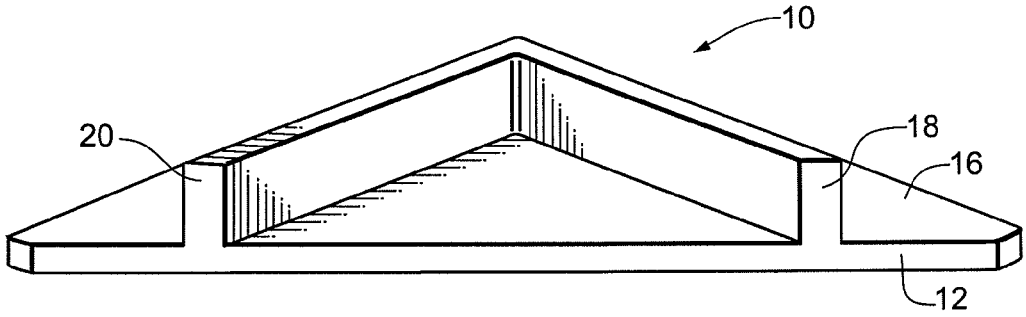
Figure 5:
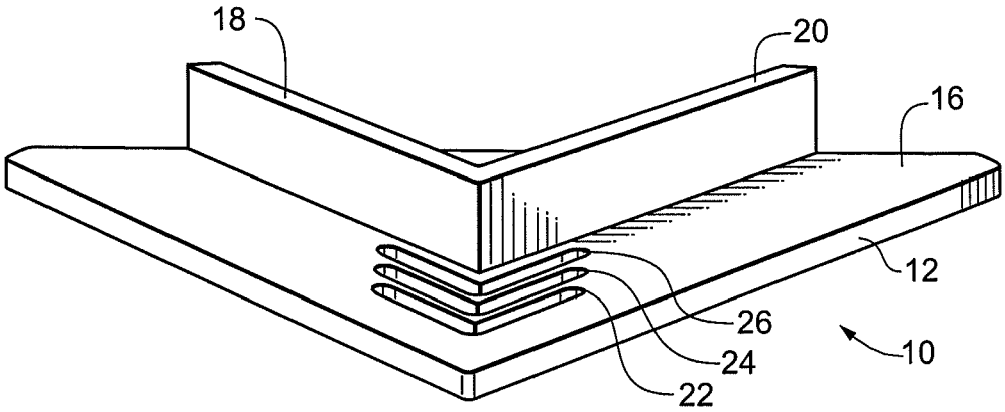
Figure 6:
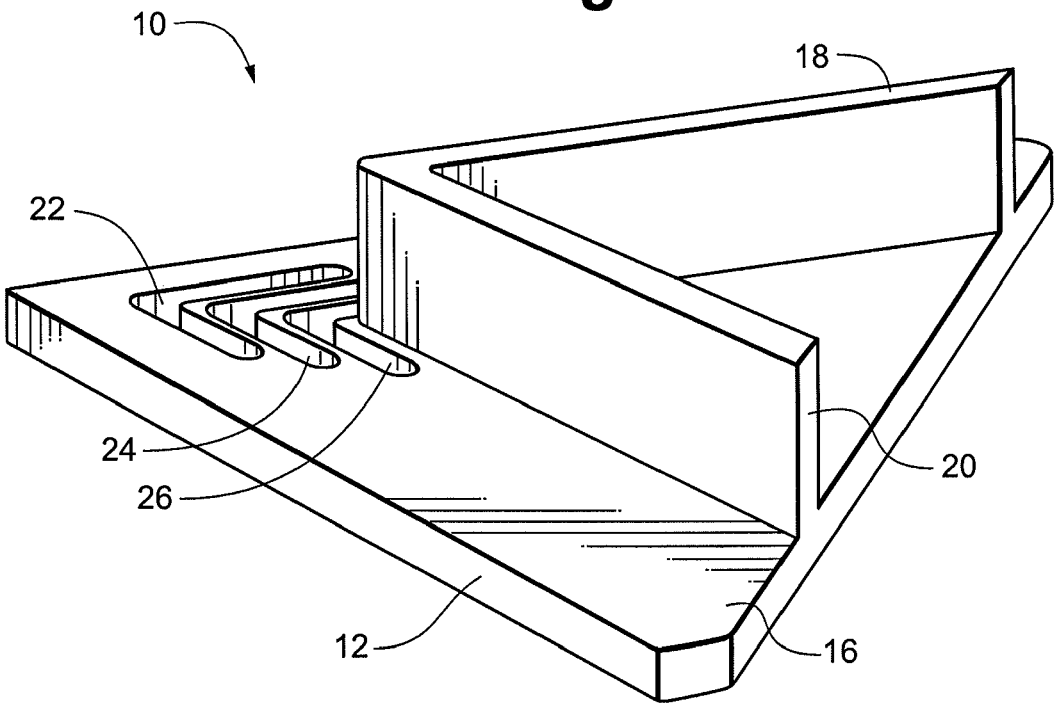
Figure 7:
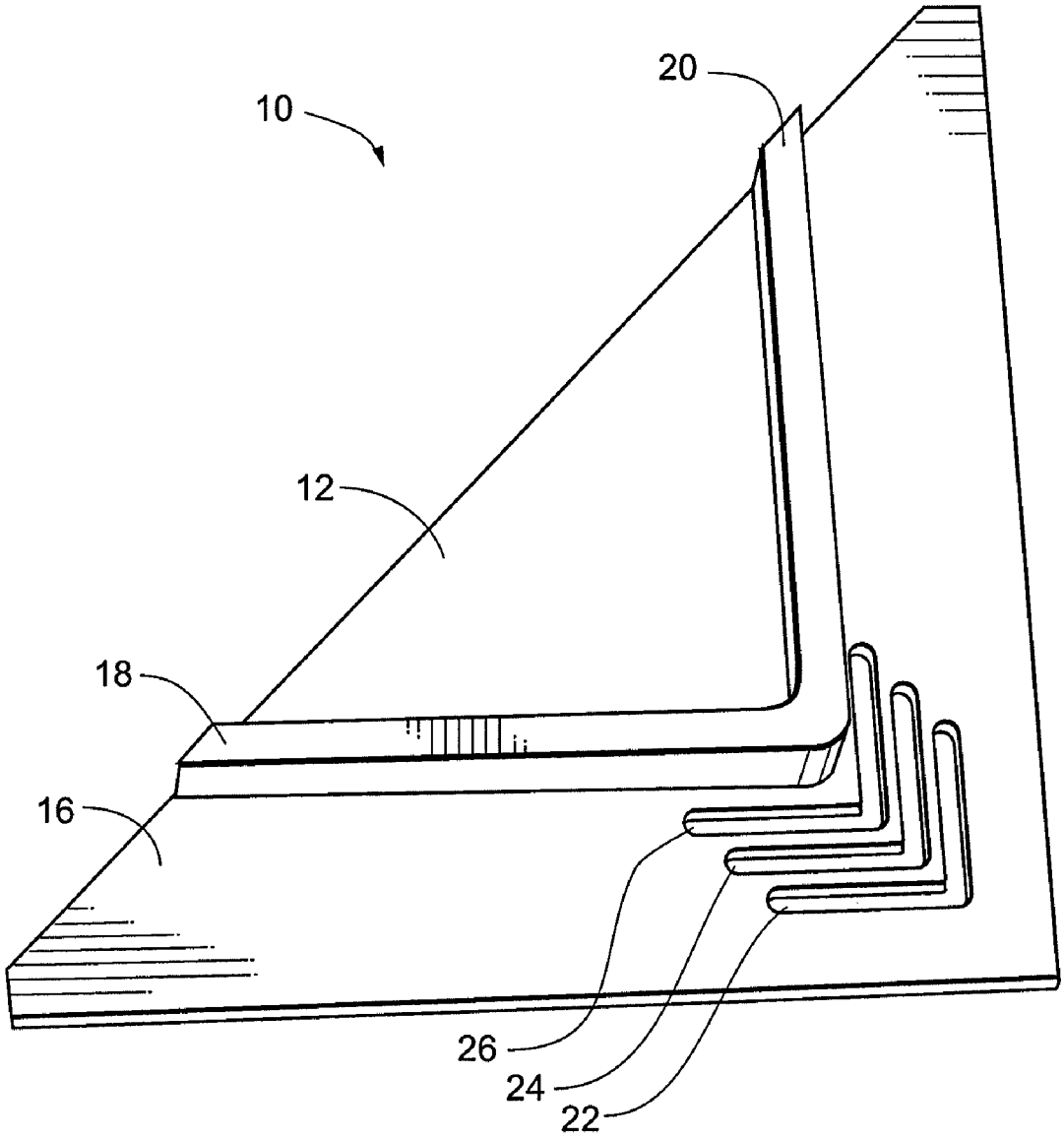
Figure 8:
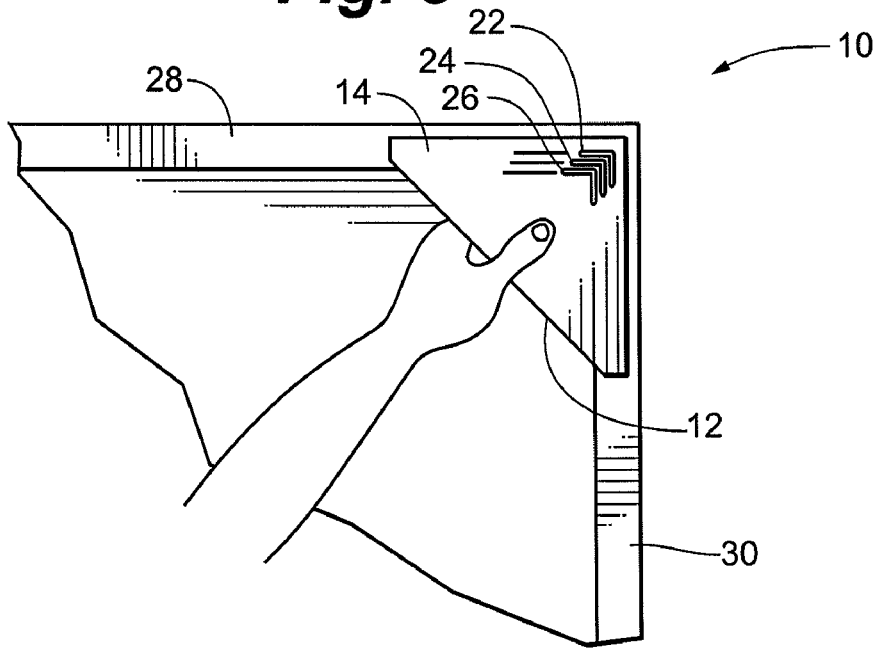
FIG. 8 is a top view of the reveal tool of FIG. 1 being positioned in contact with first and second jambs of a door or window.
Figure 9:
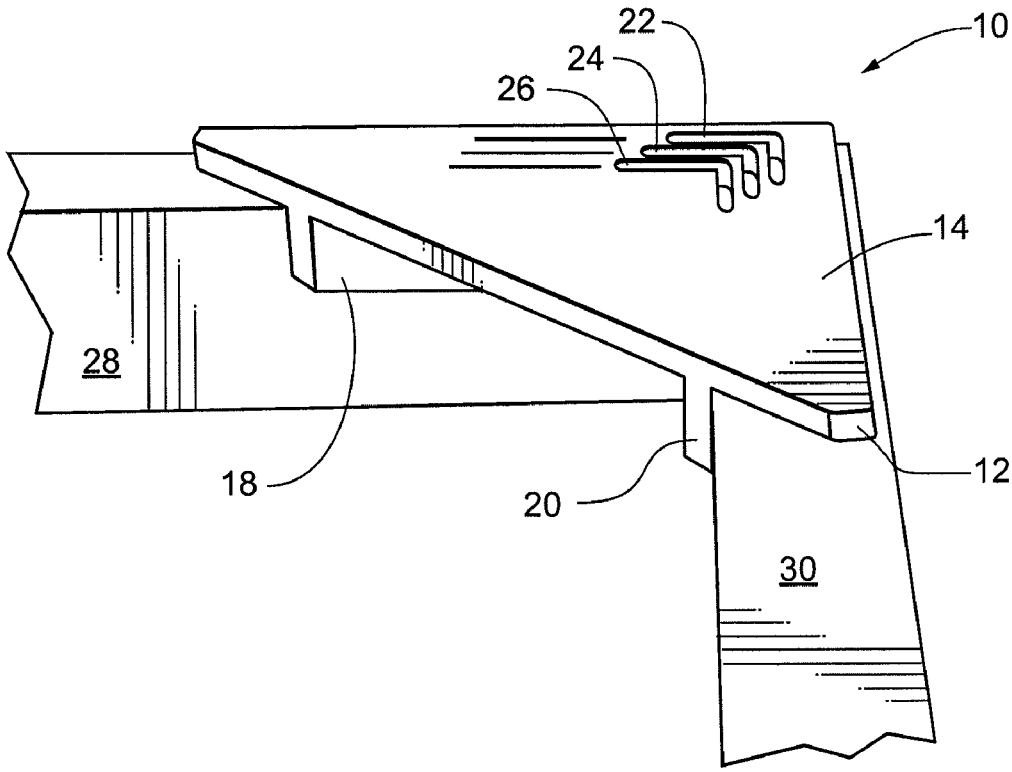
FIGS. 9-11 are perspective views of the reveal tool of FIG. 1 positioned in contact with first and second jambs of a door or window.
Figure 10:
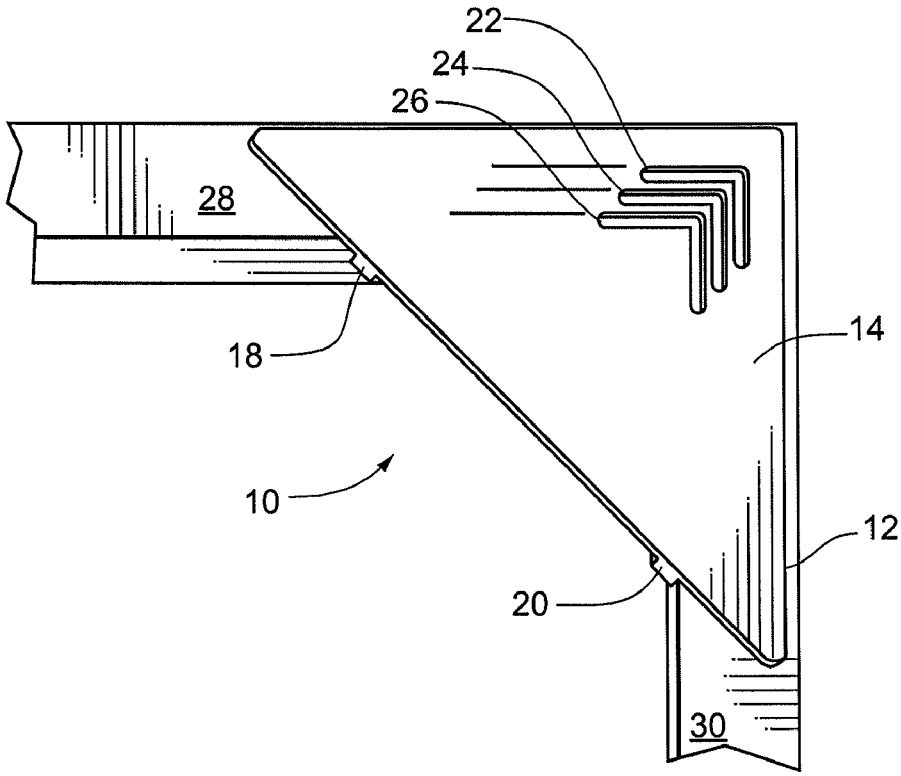
Figure 11:
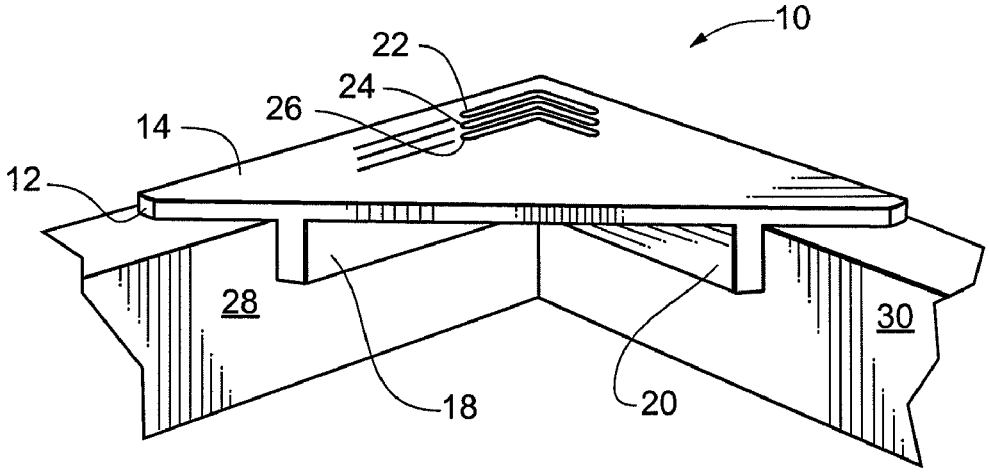
Figure 12:
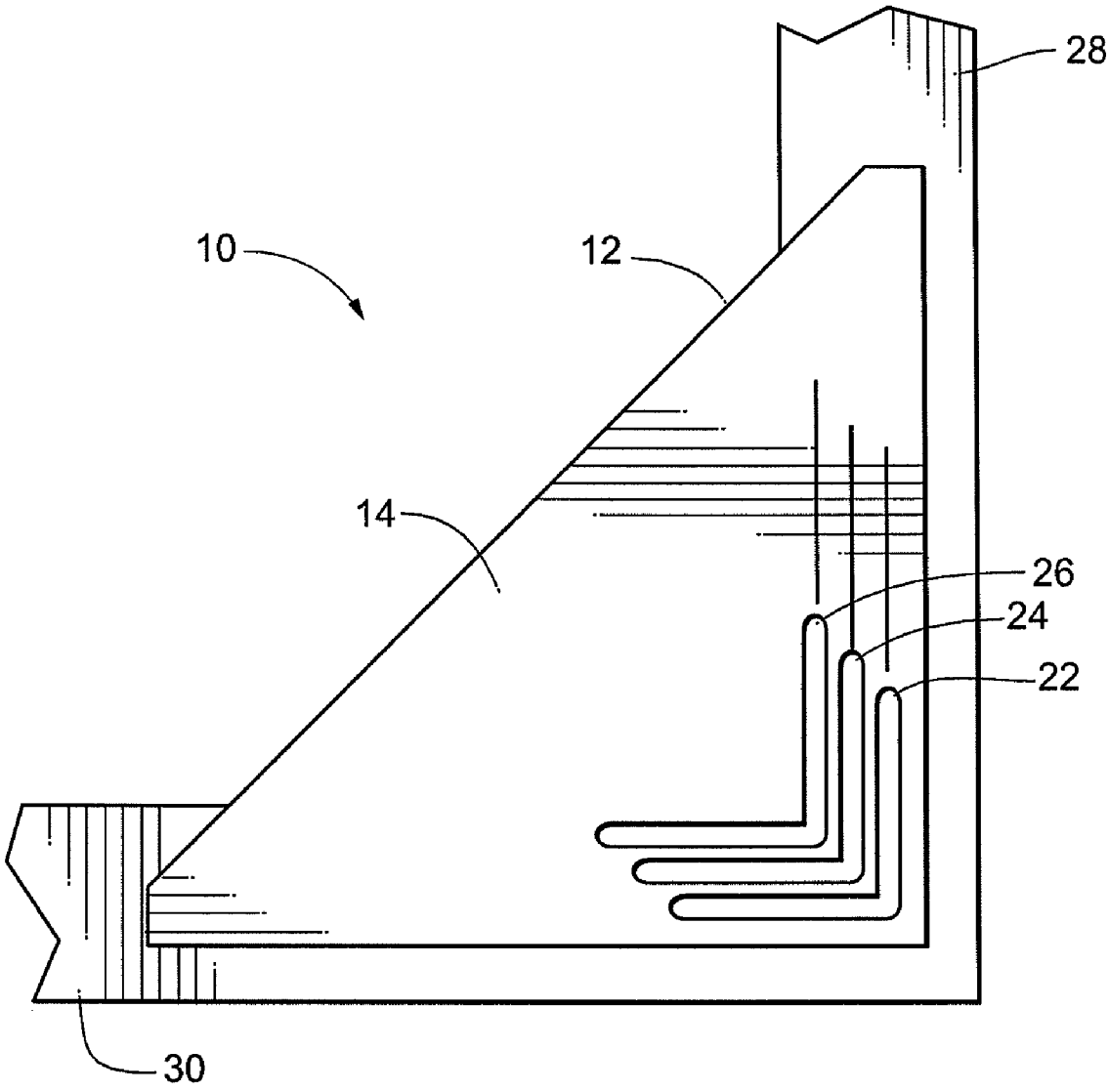
FIG. 12 is a top view of the reveal tool of FIG. 1 positioned in contact with first and second jambs of a door or window.

FIGS. 1-12 show a reveal tool 10, according to some embodiments of the present invention. In some embodiments, the reveal tool 10 can simplify the process of marking reveal widths on door jambs and/or window jambs. The reveal tool of FIGS. 1-12 includes a base 12. The base 12 is a plate having top and bottom faces 14, 16 that are generally planar. The shape of the base 12 is approximately that of an isosceles right triangle, with two of the sides being approximately equal in length and being arranged generally perpendicularly to one another. The corners of the base 12 are blunted. Two rails 18, 20 extend downwardly from the base. The rails 18, 20 are oriented generally perpendicular relative to the base and relative to each other. Three grooves 22, 24, 26 extend through the base 12. The grooves 22, 24, 26 are positioned near the approximately right angle of the base 12. The rays of grooves 22, 24, 26 form approximately right angles. The rays for each of the grooves 22, 24, 26 are oriented generally parallel to the corresponding ray in the other grooves 22, 24, 26 and to the corresponding edge of the base 12.

The reveal tool 10 shown in FIGS. 1-12 is sized to fit into a standard craftsperson's pocket or tool belt. In some embodiments, the surface area of the top face 14 of the base 12 is approximately 4.5 in.$^2$ (29.0322 cm$^2$)—3 in. (7.62 cm) for both of the approximately equal sides. The rails 18, 20 can extend approximately ⅜ in. (0.9525 cm) from the bottom face 16 of the base 12. Accordingly, the reveal tool 10 of FIGS. 1-12 could fit within a compartment having a volume of approximately 1.6875 in.$^3$ (27.65317 cm$^3$). Obviously, the reveal tool 10 of FIGS. 1-12 could likewise fit within a compartment larger than 1.6875 in.$^3$ (27.65317 cm$^3$). Many embodiments of the reveal tool 10 are smaller than 4 in. (10.16 cm) high, 4 in. (10.16 cm) wide, and 1 in. (2.54 cm) thick. Some embodiments of the reveal tool 10 are smaller than 3.5 in. (8.89 cm) high, 3.5 in. (8.89 cm) wide, and 0.5 in. (1.27 cm) thick.

The reveal tool 10 could be manufactured in a variety of ways. The reveal tool of FIGS. 1-12 is machined out of aluminum. In some embodiments, the reveal tool can be injection molded out of a suitable polymer. Many other suitable manufacturing processes, and many other suitable materials, (sometimes in combination) can be used to manufacture the reveal tool 10.

The reveal tool 10 shown in FIGS. 1-12 can be modified in a variety of ways. For example, the two rails 18, 20 need not intersect. The rails 18, 20 are but one example of positioning members that can be used in reveal tool embodiments. Other examples of positioning members include two or more pegs, a specially designed block, and any other suitable means for stabilizing the reveal tool against door/window jambs. Some embodiments may include a greater or lesser number of grooves 22, 24, 26. In some embodiments, the base 12 can be shaped other than as an isosceles right triangle. For example, the base 12 could be circular or could have any other suitable ergonomic 2D or 3D shape. In some embodiments, the groove rays do not meet in a corner to form a single groove. The grooves 22, 24, 26 are but one example of means for guiding a writing instrument in marking reveal widths. Other examples include open edges. The dimensions provided herein are for purposes of illustration only. The reveal tool 10 may come in various sizes and shapes.

In use, the reveal tool 10 of FIGS. 1-12 can be pressed into a corner made by the intersection of two window/door jambs 28, 30 (best shown in FIGS. 8-12). One rail 18 can be pressed against the interior surface of one of the jambs 28, and the other rail 20 can be pressed against the interior surface of the other jamb 30. A portion of the bottom face 16 of the base 12 can be pressed against the front surfaces of the jambs 28, 30. The rails 18, 20 can be sized so that the reveal tool 10 does not slip when pressed into the corner.

With the reveal tool 10 snugly pressed against the corner of the two jambs 28, 30, the craftsperson can choose which of the grooves 22, 24, 26 corresponds to the desired reveal width. The grooves 22, 24, 26 can be positioned such that reveal widths can be marked anywhere along the jambs 28, 30. The lateral spacing between the outside surface of the rails 18, 20 and the grooves 22, 24, 26 determines the reveal widths of the grooves 22, 24, 26. The reveal widths of the three grooves 22, 24, 26 of the reveal tool shown in ⅛ in. (0.3175 cm), ¼ in. (0.635 cm), and ⅜ in. (0.9525 cm). When the craftsperson has chosen a groove 22, 24, 26, he or she can trace a pencil along the jambs 28, 30 within the chosen groove 22, 24, 26. This tracing creates a corner, with a line on each of the jambs 28, 30 at the desired reveal width. The craftsperson could then repeat the process in the other corners of the window/door. In some instances, a craftsperson can easily vary the reveal width from one edge to another (e.g., ¼ in. (0.635 cm) on the top of a door and ⅛ in. (0.3175 cm) on the sides).

In some embodiments, the reveal tool is shaped as a square. In such embodiments, a single groove that corresponds to a single reveal width can be located near each of the four corners. There are four rails extending downwardly away from the bottom surface of the base. Thus, when selecting the groove that corresponds to the desired reveal width, the craftsperson simply rotates the reveal tool before pressing the reveal tool into the corner of the jambs, making sure that the selected groove interfaces with the jambs.

Thus, embodiments of the reveal tool are disclosed. One skilled in the art will appreciate that the reveal tool can be practiced with embodiments other than those disclosed. The disclosed embodiments are presented for purposes of illustration and not limitation, and the present invention is limited only by the following claims.

What is claimed is:

1. A tool for marking reveal widths, comprising:
a base;
a first positioning member extending from the base and adapted to contact a first jamb of a door or window;
a second positioning member extending from the base and adapted to contact a second jamb of the door or window;
a first groove ray extending through the base at a first lateral distance from where the first positioning member is adapted to contact the first jamb of the door or window, the first groove ray running generally parallel to the first jamb of the door or window; and
a second groove ray extending through the base at a second lateral distance from where the second positioning member is adapted to contact the second jamb of the door or window, the second groove ray running generally parallel to the second jamb of the door or window,
the first lateral distance being a first reveal width and the second lateral distance being a second reveal width.

2. The tool of claim 1, wherein the first reveal width and the second reveal width are substantially equal.

3. The tool of claim 1, wherein the first and second groove rays meet in a corner of the door or window to form a single groove.

4. The tool of claim 1, wherein the first and second positioning members comprise first and second rails.

5. The tool of claim 4, wherein the first and second rails meet in a corner of the door or window.

6. The tool of claim 1, wherein the base comprises a top surface that is generally triangular.

7. The tool of claim 1, further comprising:
a third groove ray extending through the base at a third lateral distance from where the first positioning member is adapted to contact the first jamb of the door or window, the third groove ray running generally parallel to the first jamb of the door or window; and
a fourth groove ray extending through the base at a fourth lateral distance from where the second positioning member is adapted to contact the second jamb of the door or window, the fourth groove ray running generally parallel to the second jamb of the door or window,
the third lateral distance being a third reveal width and the fourth lateral distance being a second reveal width.

8. The tool of claim 7, further comprising:
a fifth groove ray extending through the base at a fifth lateral distance from where the first positioning member is adapted to contact the first jamb of the door or window, the fifth groove ray running generally parallel to the first jamb of the door or window; and
a sixth groove ray extending through the base at a sixth lateral distance from where the second positioning member is adapted to contact the second jamb of the door or window, the sixth groove ray running generally parallel to the second jamb of the door or window,
the fifth lateral distance being a fifth reveal width and the sixth lateral distance being a sixth reveal width.

9. The tool of claim 8, wherein the third and fourth reveal widths are substantially equal, and the fifth and sixth reveal widths are substantially equal.

10. The tool of claim 1, wherein the tool is smaller than 4 in. (10.06 cm) high, 4 in. (10.16 cm) wide, and 1 in. (2.54 cm) thick.

11. The tool of claim 1, wherein the first and second groove rays are adapted to accommodate a standard pencil.

12. A method for marking reveal widths, comprising:
positioning a reveal tool in contact with first and second jambs of a door or window, the reveal tool comprising:
a base,
a first positioning member extending from the base and adapted to contact the first jamb of the door or window,
a second positioning member extending from the base and adapted to contact the second jamb of the door or window,
a first groove ray extending through the base at a first lateral distance from where the first positioning member is adapted to contact the first jamb of the door or window, the first groove ray running generally parallel to the first jamb of the door or window, and
a second groove ray extending through the base at a second lateral distance from where the second positioning member is adapted to contact the second jamb of the door or window, the second groove ray running generally parallel to the second jamb of the door or window,
the first lateral distance being a first reveal width and the second lateral distance being a second reveal width; and
marking the first and second reveal widths with a writing instrument.

13. The method of claim 12, wherein the first reveal width and the second reveal width are substantially equal.

14. The method of claim 12, wherein the first and second groove rays meet in a corner of the door or window to form a single groove.

15. The method of claim 12, wherein the first and second positioning members comprise first and second rails.

16. The method of claim 15, wherein the first and second rails meet in a corner of the door or window.

17. The method of claim 12, wherein the base comprises a top surface that is generally triangular.

18. The method of claim 12, wherein the reveal tool further comprises:

a third groove ray extending through the base at a third lateral distance from where the first positioning member is adapted to contact the first jamb of the door or window, the third groove ray running generally parallel to the first jamb of the door or window; and a fourth groove ray extending through the base at a fourth lateral distance from where the second positioning member is adapted to contact the second jamb of the door or window, the fourth groove ray running generally parallel to the second jamb of the door or window, the third lateral distance being a third reveal width and the fourth lateral distance being a second reveal width.

19. The method of claim i8, wherein the reveal tool further comprises:

a fifth groove ray extending through the base at a fifth lateral distance from where the first positioning member is adapted to contact the first jamb of the door or window, the fifth groove ray running generally parallel to the first jamb of the door or window; and a sixth groove ray extending through the base at a sixth lateral distance from where the second positioning member is adapted to contact the second jamb of the door or window, the sixth groove ray running generally parallel to the second jamb of the door or window, the fifth lateral distance being a fifth reveal width and the sixth lateral distance being a sixth reveal width.

20. The method of claim 19, wherein the first and second reveal widths are substantially equal, the third and fourth reveal widths are substantially equal, and the fifth and sixth reveal widths are substantially equal.

21. The method of claim 20, wherein the first and second reveal widths are greater than the third and fourth reveal widths, and the third and fourth reveal widths are greater than the fifth and sixth reveal widths.

22. The method of claim 12, wherein the reveal tool is smaller than 4 in. (10.16 cm) high, 4 in. (10.16 cm) wide, and 1 in. (2.54 cm) thick.

23. The method of claim 12, wherein the writing instrument is a standard pencil.

* * * * *